F8958 XR 4,039,426

United States Patent [19]

Schutte

[11] 4,039,426

[45] Aug. 2, 1977

[54] PROCESS FOR PRODUCING FLUID FUEL FROM COAL

[75] Inventor: August H. Schutte, Lexington, Mass.

[73] Assignee: Arthur D. Little, Inc., Cambridge, Mass.

[21] Appl. No.: 654,521

[22] Filed: Feb. 2, 1976

[51] Int. Cl.[2] ..... C10G 1/06

[52] U.S. Cl. ..... 208/8; 208/50

[58] Field of Search ..... 208/8, 50

[56] References Cited

U.S. PATENT DOCUMENTS

| | | | |
|---|---|---|---|
| 2,221,410 | 11/1940 | Pier | 208/8 |
| 2,686,152 | 8/1954 | Franke | 208/8 |
| 3,018,242 | 1/1962 | Gorin | 208/8 |
| 3,117,921 | 1/1964 | Gorin | 208/50 |
| 3,503,864 | 3/1970 | Nelson | 208/8 |
| 3,518,182 | 6/1970 | Peterson | 208/50 |
| 3,733,183 | 5/1973 | Singh | 208/8 |

*Primary Examiner*—Delbert E. Gantz
*Assistant Examiner*—James W. Hellwege
*Attorney, Agent, or Firm*—Bessie A. Lepper

[57] ABSTRACT

Process for producing fluid fuel from coal using a hydrogen-donor solvent as an extractant. Moisture-free, preheated coal in particulate form is contacted in a drum with hot solvent to extract the hydrocarbons therefrom. Subsequently, the pressure is released to vaporize the solvent and at least a portion of the hydrocarbons extracted. The temperature of the mass in the drum is then raised under conditions required to crack the hydrocarbons in the drum and to produce, after subsequent stripping, a solid coke residue. The hydrocarbon products are removed and fractionated into several cuts, one of which is hydrotreated to form the required hydrogen-donor solvent while other fractions can be hydrotreated or hydrocracked to produce a synthetic crude product. The heaviest fraction can be used to produce ash-free coke especially adapted for hydrogen manufacture. The process can be made self-sufficient in hydrogen and furnishes as a by-product a solid carbonaceous material with a useful heating value.

26 Claims, 1 Drawing Figure

TX 423/648.1

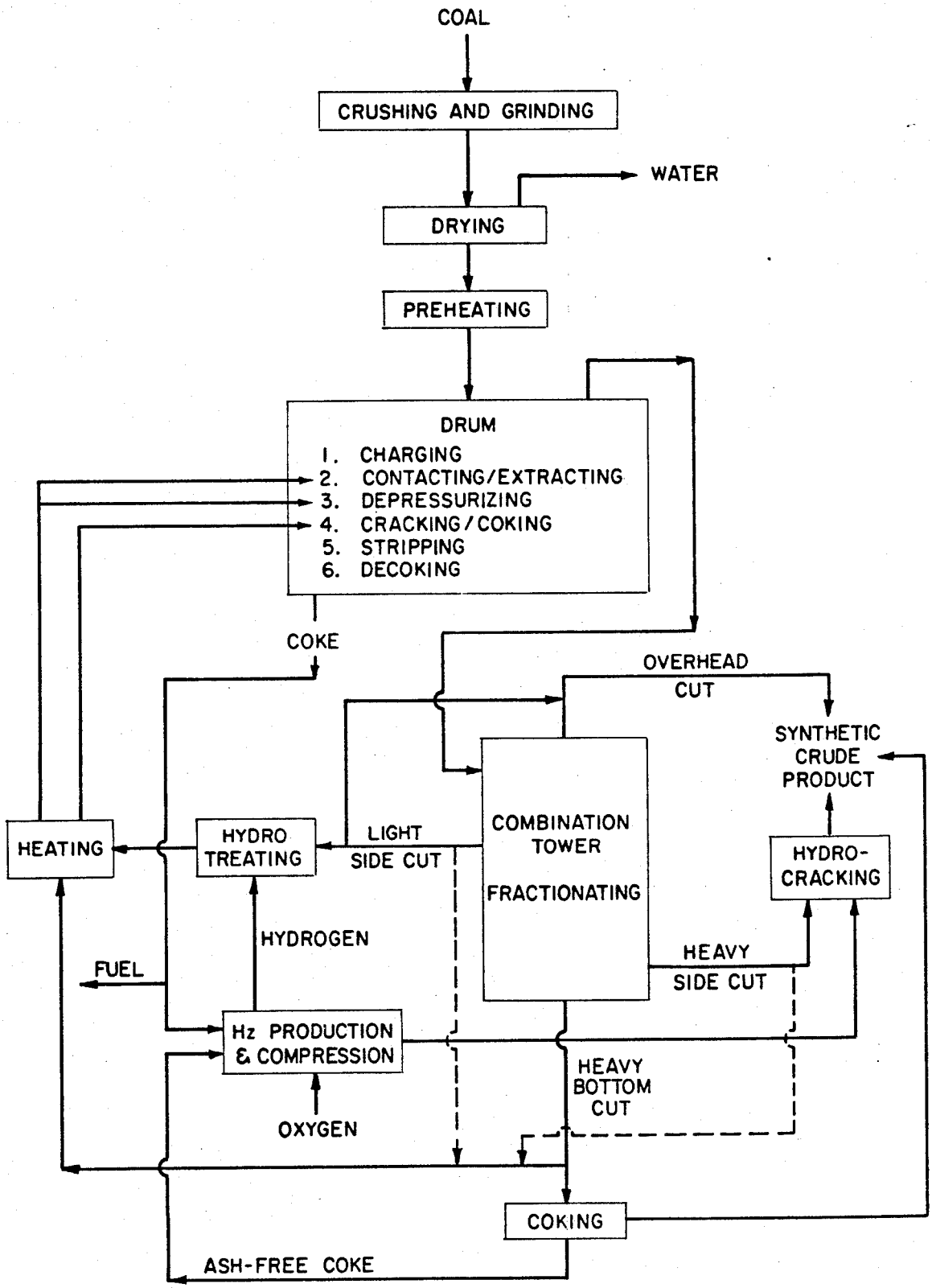
COAL
CRUSHING AND GRINDING
WATER
DRYING
PREHEATING
DRUM
1. CHARGING
2. CONTACTING/EXTRACTING
3. DEPRESSURIZING
4. CRACKING/COKING
5. STRIPPING
6. DECOKING
COKE
OVERHEAD CUT
SYNTHETIC CRUDE PRODUCT
HEATING
HYDRO TREATING
LIGHT SIDE CUT
COMBINATION TOWER
FRACTIONATING
HYDRO-CRACKING
HYDROGEN
FUEL
HEAVY SIDE CUT
Hz PRODUCTION & COMPRESSION
HEAVY BOTTOM CUT
OXYGEN
COKING
ASH-FREE COKE

PROCESS FOR PRODUCING FLUID FUEL FROM COAL

This invention relates to the conversion of coal to liquid fuel and more particularly to a process for the production of fluid (gas and liquid) hydrocarbon fuels from coal.

The possibilities of gasifying and of liquefying coal to obtain hydrocarbon fuels have been recognized for some time; but up until recently the economic impetus to provide efficient and profitable processes for carrying out the techniques developed has been lacking. Now, however, with the realization that known vast coal deposits must be looked to for meeting a much larger proportion of our energy requirements in the future, the need for improved processes for converting coal into some forms of fluid fuels becoms of paramount interest.

The process of this invention is concerned with the conversion of coal to liquid hydrocarbon fuels in contrast to its conversion to a synthetic natural gas. There are several important advantages to the liquefaction of coal as compared to gasification. Among such advantages are the requirement for less hydrogen, the use of less drastic physical conditions, the greater ease of storing and transporting, and the ability to use the resulting liquid fuels as feedstock for chemical processes.

The liquefaction of coal may give rise to several different types of products which are generally classified as deashed coal, low-sulfur heavy fuel oil, synthetic crude oil, and premium white fuels. The first two of these types present as yet unsolved problems in production and handling and they are therefore not considered although they can be made by the process of this invention if they ever become standard commercial products. For some purposes, synthetic crude oil is the optimum product; while in others the premium white fuels are desired. Since, however, the synthetic crudes can be converted to white fuels by refinery-type hydro-processing and treating, both of these two types of products resulting from the liquefaction of coal are made available though the practice of this invention.

There have been several prior art approaches to the liquefaction of coal. The first of these may be termed the Fischer-Tropsch method and it involves the gasification of coal to produce a gas, containing hydrogen and carbon monoxide, that is subsequently reacted over a catalyst to produce liquid fuels such as hydrocarbons or methanol. In a second prior art process for liquefying coal, the coal is heated in an inert atmosphere to drive off volatiles from which oils are condensed. More importantly, fuels for the German military in World War II were made from coal by high pressure (5000 to 7000 psi) hydrogenation in slurry form with a catalyst. Two presently known processes involve solvent extraction. In one of these, the coal is treated with a recycled coal oil; solids are removed by filtration, centrifugation; and the resulting ash-free liquid is then hydrogenated if desired. In the other coal liquefaction process involving solvent extraction, which has probably received the most attention of all of these processes, a slurry of coal and recycled oil is reacted with hydrogen under pressure (e.g. 2000–3000 psi) in the presence of a catalyst in an ebullated bed. When solids are removed, the liquid product can be further treated by reaction with hydrogen. The last of these processes is referred to as the "H-coal" process and has been widely described in the literature.

Those processes which begin with gasification have several important inherent disadvantages, among which are high hydrogen requirements and therefore high cost, relatively low yield, low thermal efficiency and need for relatively drastic physical conditions. The last two processes based upon solvation require very high pressure and present serious problems in a catalyst separation, heat exchange with slurries and in solid-liquid separation at high temperatures and pressures.

From this brief discussion of the prior art it will be seen that it would be desirable to have a process available for the liquefaction of coal which eliminated or at least to some extent minimized the disadvantages associated with prior art processes.

It is therefore a primary object of this invention to provide an improved process for making synthetic crude oil from coal, the process being based upon the liquefaction of coal through solvation. A further primary object is to provide such a process which produces fluid hydrocarbon fuels from coal which are, during production, cracked to a lower boiling range and upgraded in that the hydrogen to carbon ratio is increased; which produces these fuels in a form which makes them more suitable for subsequent hydrocracking and desulfurization; and which also produces inert solid carbonaceous material with a low but useful heating value. It is another object of this invention to provide a process of the character described which is efficient and requires less drastic operating conditions than heretofore used in the liquefaction of coal.

Still aother object is to provide a coal liquefaction process which is based upon the use of a recycled solvent and which eliminates the need for pumping slurries, indirect heat exchange with them and the necessity for the letdown of these slurries through pressure-reducing valves. Yet another object of this invention is the providing of a coal liquefaction process which eliminates mechanical separation procedures including the filtration of ash and residue solids from liquids. It is an addtional object to provide a coal liquefaction process which is sufficiently flexible in operation to produce synthetic crude oils which will produce premium white fuels when charged to a conventional oil refinery, and which provides the necessary carbon source to react with water and oxygen to form the hydrogen required to produce the desired liquid fuel product line.

In brief the process of this invention comprises the steps of contacting moisture-free, preheated coal in particulate form with a hydrogen donor solvent at a temperature ranging between about 700° and 900° F under a pressure sufficient to maintain essentially all of the solvent in the drum in a liquid state thereby to heat the coal to a temperature between about 650° and 800° F and to extract a substantial portion of the soluble hydrocarbon fractions from said coal; decreasing the pressure and providing the latent heat required to volatilize the solvent while withdrawing the light end of the extract formed; adding a hydrocarbon fraction at an elevated temperature sufficient to heat the contents of the drum to about 900° F in a quantity, for a time and at a pressure sufficient to crack at least a portion of the hydrocarbon fractions extracted from the coal and to coke the residual solids in the drum thereby to produce a fluid hydrocarbon product; removing the fluid hydrocarbon product from the drum; and decoking the drum to remove the coked residue therefrom. The resulting hydrocarbon extract is fractionated into several cuts, the light overheat cut providing a synthetic crude product, the light side cut after hydrotreating serving as the hydrogen donor solvent, the heavy side cut being subjected to hydrocracking to give additional synthetic crude product and the heavy bottom cut being coked to form ash-free coke for hydrogen production and additional synthetic crude and/or being used, after heating, to provide the heat for the cracking/coking step in the drum.

The invention accordingly comprises the several steps and the relation of one or more of such steps with respect to each of the others thereof, which will be exemplified in the following detailed disclosure, and the scope of the invention will be indicated in the claims.

For a fuller understanding of the nature and objects of the invention, reference should be had to the following detailed description taken in connection with the accompanying drawing which is a flow diagram detailing the steps of the process of this invention.

As will be seen in the flow diagram of the drawing, the first step of the process is the providing of a coal feed in particulate form. This may conveniently be done by crushing and grinding the coal in any suitable conventional apparatus. The particle size of the feed coal is preferably such that essentially all of it will pass a standard 8-mesh sieve. The coal feed in particulate form is then dried to remove the water vapor of the coal to form a moisture-free coal.

The dry coal is then preheated to a temperature below its autoignition temperature. Depending upon the type of coal used, the step of preheating may be combined with drying in a single step; or it may be performed subsequent to drying, such as in the reaction drum, for example. Heat for preheating may be supplied by burning low-Btu gas produced from the coal residue as described below or by using waste heat from flue gases from the process heaters.

The combined steps which effect the extraction of the liquid fuel from the coal and the subsequent production of the resulting extracted fluid hydrocarbons are among the most important features of the process of this invention. It is through these steps, performed in the way described, that it is possible to eliminate both the handling of liquid-solid slurries and the necessity for drastic physical conditions (both temperature and pressure) such as are required by prior art processes.

The steps of extraction, cracking and coking, along with such subsequent steps as final liquid recovery and decoking, are preferably carried out in a drum such as is used for delayed coking. A combination tower for fractionation of the liquid hydrocarbons produced is associated with one or more drums.

As will be apparent from the following discussion, the total extraction is performed in several steps, the conditions for which may be varied within certain limits. These steps may be termed contacting/extracting using heating and pressurization, depressurizing, cracking-/coking, stripping and finally decoking to remove the solid residue to place the drum in condition for the repetition of these steps. The overall extraction phase of this process is therefore, of necessity, a batch operation. However, as will be described below, several drums may be used in series with the fractionating equipment operating continuously to make it possible to obtain an essentially continuous operation.

The dried coal before or after preheating is charged into the drum. After the desired quantity of coal is introduced into the drum it is contacted with a hydrogen-donor solvent heated to a temperature between about 700° and 900° F, the pressure in the drum being maintained at that level at which substantially all of the solvent is in the liquid phase. Thus liquid solvent is brought into contact with the coal. This bringing of the liquid solvent into contact with the coal can be effected in one of two ways. In the first of these process embodiments, the hot solvent is introduced into the drum as a vapor after the drum has been pressurized with an inert gas such as nitrogen or methane or with available hydrocarbon gases. As the solvent vapor enters the drum it condenses out on the coal particles to provide the liquid solvent contact for subsequent extraction. In condensing on the coal, the solvent vapor gives up its heat of vaporization along with some of its sensible heat thus heating the coal.

In the second embodiment of the liquid solvent contacting step, the drum is pressurized, using the same types of gases as used in the first embodiment, to a level such that when hot liquid solvent under pressure is introduced into the drum it remains liquid. It also heats up the coal by giving up some of its sensible heat.

Generally the maximum pressure reached in this liquid solvent contacting step will range between about 50 and about 150 psig. For example, the pressure required in the drum for a solvent having a boiling range between about 475° and 750° F will be at least about 65 psig. In either of these process embodiments the coal mass within the drum will be heated to between about 650° and 800° F.

Solvents suitable for the contacting step are those which are known as hydrogen-donor solvents, i.e., they are able to release hydrogen to the coal. These solvents may generally be defined as a middle cut with a boiling range between about 400° and 900° F. For example phenanthrene, tetralin and naphthalene are suitable solvents. The higher boiling range solvents give deeper extraction penetration but they require greater effort in separation. As will be discussed below, the solvents for this process preferably result from moderate but controlled hydrotreatment of a selected boiling range cut of the coal-derived liquids.

As shown in the drawing, the steps of contacting and extracting are combined inasmuch as the extracting step is in essence a continuation of the contacting step, using additional quantities of the same hydrogen donor solvent at essentially the same temperature and pressure conditions obtaining at the end of the contacting step. Thus during the extracting step additional solvent at about 700° to 900° F is caused to flow through the drum while maintaining a pressure of from about 50 to 150 psig. This flow of solvent serves to agitate the mass within the drum while maintaining its temperature between about 650° to 800° F. During extraction, a substantial portion of the soluble hydrocarbon fractions of the coal is extracted to become part of the fluid contained within the drum. It is also possible during the extraction period to gradually reduce the pressure in the drum to boil off some of the solvent and thus agitate the mass in the drum to aid in the extraction.

In the combined contacting/extracting step the solvent-to-coal weight ratio may range between about 2-to-1 to about 3-to-1, depending upon the type of coal being processed and the chemical and physical characteristics of the solvent. As noted previously, the roles of the hydrogen-donor solvent are those of heating the coal and extracting the soluble hydrocarbon fractions.

Thus the optimum amount of solvent used can readily be determined by one skilled in the art for any one system from published thermodynamic and chemical data.

The time required for the combined contacting/extracting step will be that needed to bring the coal to the desired temprature, e.g., up to about 750° to about 800° F plus the time required to complete a predetermined degree of extraction. The actual extraction time will, in turn, depend upon the solvent used, the degree of extraction desired, the temperature and pressure ranges and the coal particle size. Since it is preferably to extract at least about 80 to 90% by weight of all of the extractables in the coal, the attainment of this goal will largely determine the time period required for the contacting/extracting step. Thus optimum time for this step may readily be determined for any particular combination of coal feed type and solvent used, along with the temperature and pressure ranges employed. In general, a maximum time of from about 3 to 5 hours after charging the coal into the drum should be sufficient to complete extraction.

Upon completion of the extraction of the hydrocarbon fractions from the coal, the drum is depressurized to between about 50 psig and atmospheric pressure (0 psig). As a result of this depressurization, gases and the light hydrocarbons are discharged from the drum to the combination tower for fractionating into various cuts as described below. During this depressuring, it is preferable to continue to introduce solvent vapors (which may be an unhydrogenated refractory cut) at between about 650° and 800° F into the drum.

The next step to be carried out in the drum is that of a combination of cracking the high-boiling liquids and coking the solid residue. This combined cracking/coking step is carried out by heating the drum contents up to at least 850° -900° F. This is accomplished by introducing a cut from the fractionator into the drum to transfer heat into the mass contained within the reactor drum. This liquid preferably consists of the bottom heavy fraction from the combination tower used in the fractionation of the coal-derived product hydrocarbons. Like the medium cuts used in the contacting/extracting and stripping steps, this solvent is preferably heated in a direct-fired heater.

In this cracking/coking step the pressure within the drum may range from about 15 psig to about 70 psig. If the quality of the product hydrocarbons is to be maximized, then the use of higher pressures reduces their boiling range but increases the amount of coke formed. If, however, it is desirable to maximize the yields of the product hydrocarbons rather than their quality, then cracking/coking may be carried out at the lower pressures.

The amount of high-temperature solvent introduced into the drum to achieve cracking/coking is determined by the heat requirements of the drum's contents and it may be readily calculated. The liquid inventory in the drum will gradually diminish during this phase, being controlled by the drum temperature and pressure, and the amount of gas and light cuts entering into the combination tower.

At the end of the cracking/coking step the drum contains the coal residue solids plus the coke formed from the extract plus a small amount (.e.g, 10 to 15 weight percent of the coal) of heavy residual oil. The drum outlet is then opened up full to the combination tower and its pressure is reduced to atmospheric. The drum temperature will drop from about 850° -900° F to about 750° -800° F due to oil vaporization. Steam may then be introduced to obtain an oil partial pressure of the order of about 5 psia (equivalent to 12 pounds of steam per pound of oil). This steam stripping results in the removal of additional oil and reduces the volatile matter in the coke to an acceptable level, e.g., about 9 to 12 weight percent.

The final step to be carried out in the drum, subsequent to steam stripping is that of decoking, which comprises introducing a high-pressure water jet (for example under about 2000 pounds pressure) to cut and flush out the coke from the drum.

During the steps of contacting/extracting, cracking/coking and stripping, the vapors from the drum are subjected to fractionation in the combination tower such as now employed, for example, in a delayed coking process. Since the product from the extraction is all in the form of vapors and is free of solids, including ash and unreacted carbon, no costly, difficult and time-consuming separation step such as mechanical separation of liquids and solids of a slurry, is required. In this fractionation, the vapors from the drum are separated into four cuts. The overhead cut comprises a light distillate extract ($C_1$ to 475° F boiling range), the light side cut is a recycle solvent having a boiling range between about 475° and 750° F; and the third is a heavy side cut with a boiling range of about 750° to 900° F. The bottoms contain the 900° F+ heavy extract fractions.

The light overhead can be depropanized and then blended into the synthetic crude product. Alternatively, it can be treated and used as a gasoline base stock.

A minor portion of the light side cut from the fractionation tower is withdrawn and blended into the synthetic crude product. The remainder, which is used to maintain the recycled solvent inventory in the process of this invention is upgraded for recycling. Preferably such upgrading is accomplished by subjecting this intermediate cut to a light to moderate hydrotreatment (typically by adding from about 200 to 1000 standard cubic feet of hydrogen per barrel) to produce the hydrogen-donor recycle solvent used in the contacting/extracting and stripping steps of this process. This hydrotreated material is returned to the drum for a succeeding batch extraction of coal after being heated to the desired temperature in a suitable, e.g., direct-fired, heater. This hydrotreatment is desirable inasmuch as coal-derived solvents are not always recoverable unchanged from the coal solution and since the solvent power of the untreated recycled solvent may diminish steadily so that the recovered solvent can be said to differ in some way from the original solvent. This effect is probably attributable to the presence in the original extraction solvent of traces of reactive solvent species which are consumed in the few cycles. However, if the solvent is hydrogenated prior to recycling, then there may be produced a recycle solvent, the solvent power of which is at least equal to that of the starting solvent.

The heavy side stream from the fractionator, comprising extract distillate boiling in the 750° to 900° F range, constitutes, after hydrocracking, the heavy end of the synthetic crude product of this invention. Hydrocracking of this 750°-900° F cut plus the net production of the 400°-750° F cut succeeds in adding from about 200 to 3,000 standard cubic feet of hydrogen per barrel to these hydrocarbons and produces a $C_5$ to 750°/800° F synthetic crude product which is a premium charging stock for a conventional oil refinery.

Finally, the heavy bottom cut (boiling range in excess of 900° F) from the fractionation step requires too much hydrogen to economically convert it to suitable feed for further refining to white products. It is therefore preferably returned to the drum as the high-temperature solvent used for the cracking/coking step. Alternatively, it may be subjected to a separate coking step to produce ash-free coke for sale as high-purity coke for electrodes and such or for producing hydrogen for the process.

All of the hydrogen required in the hydroconversion of the light and intermediate cuts, as well as for the hydrotreating of the heavy side cut, may be furnished in the process (i.e., no hydrogen need be provided from external sources). In doing this, a portion of the high-ash coke resulting from the coking step after extraction is used as a reducant; and in addition, any low-ash coke produced from the heavy bottom cut may also be used. In using the heavy bottom cut to produce hydrogen, this cut from the fractionation step is coked in a fluid coker to produce an ash-free coke and a light extract, the latter, being added to the light extract stream resulting from fractionation and used as synthetic crude.

The resulting ash-free coke from the fluid coker is an ideal material for hydrogen manufacture in the process of this invention. This coke is readily fluidizable, non-abrasive, attrition resistant, has no melting point and produces no slag. It can, therefore be used as a fuel or reductant at very high temperatures without encountering molten-slage handling and disposal problems. The production of hydrogen from this ash-free coke may be accomplished, for example, in the simplest type of commercial Lurgi generator. The product gases are then subjected to conventional shift conversion steps and acid gas removal. The resulting hydrogen is finally compressed to the required pressure for hydrotreating the light side cut and for hydrocracking the heavy side cut.

The major heat requirement in the process of this invention is that for heating the solvent extract. This heating of the solvent is preferably carried out in a direct-fired heater which is typically fired by gaseous fuel. For example, this gaseous fuel, which is characterized as a low-Btu fuel gas, may be produced by gasifying the high-ash residue resulting from the decoking of the extraction drum in an air/steam-blown gasifier, for example in such commercially available apparatus as a Wellman Galusha or Lurgi gasifier. Any fuel gas with caloric valve from the hydrogen production step may be added to the low-Btu fuel gas thus formed. The heat for drying and preheating the coal particles may be furnished in whole or in part in the form of fuel gas from the solvent heater or in whole or in part by burning a portion of the low-Btu fuel gas generated by gasifying the high-ash residue.

Using the conditions specified above and hydrotreated recycled solvent as the hydrogen-donor solvent extractant, the process of this invention can produce from about 3,500 to 5,500 tons of liquid hydrocarbon product from 10,000 tons of as-mined coal (equivalent to about 9,000 tons of moisture- and ash-free coal). The overall product balance for a 10,000 tons per day process can be summarized as follows:

| | |
|---|---|
| coal as mined | 10,000 Tons |
| coal — moisture- and ash-free | 9,000 |
| liquid yield including heavy bottom cut | 4,000 - 5,500 |
| liquid yield if heavy bottom cut is coked | 3,500 - 5,200 |
| gas yield | 400 - 800 |

-continued

| | |
|---|---|
| high-ash coke | 3,700 - 5,600 |
| ash-free coke if heavy bottom cut is coked | 300 - 500 |

To the extent that the heavy bottom cut is coked the total liquid yield will decrease since such coking gives rise to ash-free coke and a light cut which forms part of the liquid yield. The ash-free coke is, in turn available for hydrogen production.

Essentially all of the gases, high-ash coke and ash-free coke (if made) are consumed in the process for fuel and for hydrogen production.

The synthetic crude product resulting from the process of this invention is free of fines and has a lower boiling range and a higher hydrogen to carbon ratio than synthetic crudes resulting from the prior art coal liquefaction processes. The synthetic crude of this process is, moreover, more suitable for hydrocracking and desulfurization to form white products.

It will thus be seen that the objects set forth above, among those made apparent from the preceding description are efficiently attained and, since certain changes may be made in carrying out the above process without departing from the scope of the invention, it is intended that all matter contained in the above description shall be interpreted as illustrative and not in a limiting sense.

I claim:

1. A process for producing fluid hydrocarbon fuels from coal, comprising the steps of a. contacting within a drum, moisture-free, preheated coal in particulate form with a hydrogen-donor solvent at a temperature ranging between about 700° and 900° F under a pressure sufficient to maintain essentially all of said solvent in said drum in a liquid state thereby to contact and heat the coal to a temperature between about 650° and 800° F and to extract a substantial portion of the soluble hydrocarbon fractions from said coal;

b. decreasing the pressure in said drum and providing the latent heat required to volatilize said solvent while withdrawing the light ends of the extract formed in step (a);

c. introducing into said drum a hydrocarbon fraction at an elevated temperature sufficient to heat the contents of said drum to about 850°-900° F in a quantity, for a time at a pressure sufficient to crack at least a portion of the remaining hydrocarbon fractions extracted from said coal and to coke the residual solids in said drum thereby to produce a fluid hydrocarbon product;

d. removing said fluid hydrocarbon product from said drum; and e. decoking said drum to remove the coked residue therefrom.

2. A process in accordance with claim 1 wherein additional hydrogen-donor solvent at a temperature between about 700° and 900° F is used in step (b) to provide said latent heat.

3. A process in accordance with claim 1 including the step of fractionating said fluid hydrocarbon product removed from said drum to form an overhead cut providing a portion of a synthetic crude, a light side cut, a heavy side cut and a heavy bottom cut.

4. A process in accordance with claim 3 including the step of hydrotreating at least a portion of said light side cut to form said hydrogen donor solvent.

5. A process in accordance with claim 3 including the step of hydrocracking said heavy side cut to form additional synthetic crude product.

6. A process in accordance with claim 3 including the step of heating at least a portion of said heavy bottom cut to serve as said liquid hydrocarbon fraction in step (c).

7. A process in accordance with claim 3 including the steps of coking at least a portion of said heavy bottom cut to form ash-free coke and a light hydrocarbon fraction, and adding said light hydrocarbon fraction to said synthetic crude.

8. A process in accordance with claim 7 including the step of using said ash-free coke and said coked residue from said drum as reductants in the formation of hydrogen.

9. A process for producing fluid hydrocarbon fuels from coal, comprising the steps of a. charging moisture-free coal in particulate form into a drum;
b. preheating said moisture-free coal;
c. contacting said preheated coal in said drum with a hydrogen-donor solvent at a temperature ranging between about 700° and 900° F;
d. pressurizing said drum with an inert or hydrocarbon gas to a pressure sufficient to maintain essentially all of said solvent in a liquid state thereby to contact and heat the coal to a temperature between about 650° and 800° F and to extract a substantial portion of the soluble hydrocarbon fractions from said coal;
e. decreasing the pressure within said drum while continuing to pass additional hydrogen-donor solvent vapors through said drum thereby to provide the latent heat required to volatilize said solvent while withdrawing the light ends of the extract formed in step (c);
f. adding to said drum a liquid hydrocarbon fraction at a temperature sufficient to heat the contents of said drum to about 850°-900° F in a quantity, for a time and at a pressure sufficient to crack at least a portion of the remaining hydrocarbon fractions extracted from said coal and to coke the residual solids in said drum thereby to produce a fluid hydrocarbon product;
g. removing said fluid hydrocarbon product from said drum;
h. decoking said drum to remove the coked residue therefrom; and
i. fractionating said fluid hydrocarbon product.

10. A process in accordance with claim 9 wherein said preheating said moisture-free coal is done prior to said charging said coal into said drum.

11. A process in accordance with claim 9 wherein said preheating said moisture-free coak is done subsequent to said charging said coal into said drum.

12. A process in accordance with claim 9 wherein said contacting said preheated coal with said solvent comprises introducing said solvent in a vapor state into said drum subsequent to said pressurizing step whereby said solvent condenses on said coal in said drum.

13. A process in accordance with claim 9 wherein said contacting of said preheated coal with said solvent comprises introducing said solvent in a liquid state under pressure into said drum subsequent to said pressurizing step.

14. A process in accordance with claim 9 wherein said step of fractionating said fluid hydrocarbon product comprises forming an overhead cut providing a portion of a synthetic crude product, a light side cut, a heavy side cut and a heavy bottom cut.

15. A process in accordance with claim 14 including the step of hydrotreating at least a portion of said light side cut to form said hydrogen-donor solvent.

16. A process in accordance with claim 14 including the step of hydrocracking said heavy side cut to form additional synthetic crude product.

17. A process in accordance with claim 14 including the step of heating at least a portion of said heavy bottom cut to serve as said liquid hydrocarbon fraction in step (f).

18. A process in accordance with claim 14 including the steps of coking at least a portion of said heavy bottom cut to form ash-free coke and a light hydrocarbon fraction, and adding said light hydrocarbon fraction to said synthetic crude.

19. A process in accordance with claim 18 including the step of using said ash-free coke and said coked residue from said drum as reductants in the formation of hydrogen.

20. A process for producing fluid hydrocarbon fuels from coal comprising the steps of a. charging moisture-free coal in particulate form into a drum.
b. preheating said moisture-free coal;
c. pressurizing said drum with an inert or hydrocarbon gas;
d. introducing into said pressurized drum a hydrogen-donor solvent at a temperature ranging between about 700° and 900° F while maintaining the pressure within said drum at a level sufficient to maintain essentially all of said solvent in a liquid state thereby to contact and heat the coal to a temperature between about 650° and 800° F and to extract a substantial portion of the soluble hydrocarbon fractions from said coal;
e. decreasing the pressure within said drum while continuing to pass additional hydrogen-donor solvent vapors through said drum thereby to-provide the latent heat required to volatilize said solvent while withdrawing the light ends of the extract formed in step (c);
f. adding to said drum a liquid hydrocarbon fraction at a temperature sufficient to heat the contents of said drum to about 850°-900° F in a quantity, for a time and at a pressure sufficient to crack at least a portion of the remaining hydrocarbon fractions extracted from said coal and to coke the residual solids in said drum thereby to produce a fluid hydrocarbon product;
g. removing said fluid hydrocarbon product from said drum;
h. decoking said drum to remove the coked residue therefrom;
i. fractionating said fluid hydrocarbon product to form an overhead cut providing a synthetic crude, a light side cut, a heavy side cut and a bottom cut;
j. fluid-coking at least a portion of said heavy bottom cut to form ash-free coke and a light hydrocarbon fraction;
k. using said ash-free coke from step (j) to form hydrogen;
l. hydrotreating at least a portion of said light side cut with hydrogen formed in step (k) to form said hydrogen-donor solvent; and m. hydrocracking at least a portion of said heavy side cut to form additional synthetic crude.

21. A process in accordance with claim 20 wherein said liquid hydrocarbon fraction used in step (f) comprises a portion of said light cut, a portion of said heavy side cut, a portion of said heavy bottom cut or a combination of two or more of said cuts.

22. A process in accordance with claim 20 wherein said hydrogen-donor solvent introduced into said drum in step (d) is in the vapor state whereby said solvent condenses on said coal in said drum.

23. A process in accordance with claim 20 wherein said hydrogen-donor solvent introduced into said drum in step (d) is a liquid under pressure.

24. A process in accordance with claim 20 including the steps of pressurizing said drum up to about 70 psig during step (f) and subsequently depressurizing said drum after said hydrocarbon fractions have been cracked and said residual solids have been coked.

25. A process in accordance with claim 20 wherein said step of removing said fluid hydrocarbon product from said drum includes steam stripping.

26. A process in accordance with claim 20 including gradually decreasing the pressure in said drum during the extracting period in step (d) thereby to boil off some of said solvent and to agitate said contents of said drum.

* * * * *